US006585832B2

(12) United States Patent
Kim

(10) Patent No.: US 6,585,832 B2
(45) Date of Patent: Jul. 1, 2003

(54) METHOD TO PREVENT SPECKS OR HAIRLINE CRACKS IN, AND PREMATURE FAILURE OF, AIRPLANE CYLINDER BARRELS

(75) Inventor: Yoon Sam Kim, Williamsport, PA (US)

(73) Assignee: Textron Limited, Williamsport, PA (US)

( * ) Notice: Subject to any disclaimer, the term of this patent is extended or adjusted under 35 U.S.C. 154(b) by 0 days.

(21) Appl. No.: 09/851,688

(22) Filed: May 9, 2001

(65) Prior Publication Data

US 2003/0031810 A1 Feb. 13, 2003

(51) Int. Cl.[7] ..... C23C 22/00

(52) U.S. Cl. ..... 148/243; 148/284; 148/287; 123/669; 123/193.1; 123/193.2

(58) Field of Search ..... 148/243, 284, 148/287; 123/668, 669, 193.1, 193.2

(56) References Cited

U.S. PATENT DOCUMENTS 3,279,957 A * 10/1966 Fink ..... 148/243
4,614,185 A * 9/1986 Fox ..... 123/193.2
6,309,476 B1 * 10/2001 Ravenscroft et al. ..... 148/243

* cited by examiner

*Primary Examiner*—John Sheehan
*Assistant Examiner*—Andrew L. Oltmans
(74) *Attorney, Agent, or Firm*—Greenburg Traurig, LLP; Paul F. McQuade, Esq.

(57) ABSTRACT

The present invention relates to an improved method for the manufacture of aircraft engine cylinder barrels to prevent their premature failure due to hairline cracks or specks thought to be caused by caustic stress corrosion cracking during black oxide treatment. Machined aircraft cylinder barrels immersed into a black oxide chemical bath composed of a solution containing about 60% sodium hydroxide, about 0% sodium nitrate, and about 40% sodium nitrite most effectively prevents specks and hairline cracks. Since residual stresses from machining also contribute to the probability that specks or hairline cracks will occur during black oxide treatment, the maximum selected number of cylinder barrels essentially free of detectible specks or hairline cracks determines the maximum number of cylinder barrels to be machined on a given set of tool bits.

11 Claims, 3 Drawing Sheets

The 101st machined cylinder barrel revealed no specks in general, but a few localized areas exhibited small specks up to 0.00003 inch in depth in the cooling fin roots after black oxide treatment using 60%NaOH / 20%$NaNO_3$ 20%$NaNO_2$. 1013X

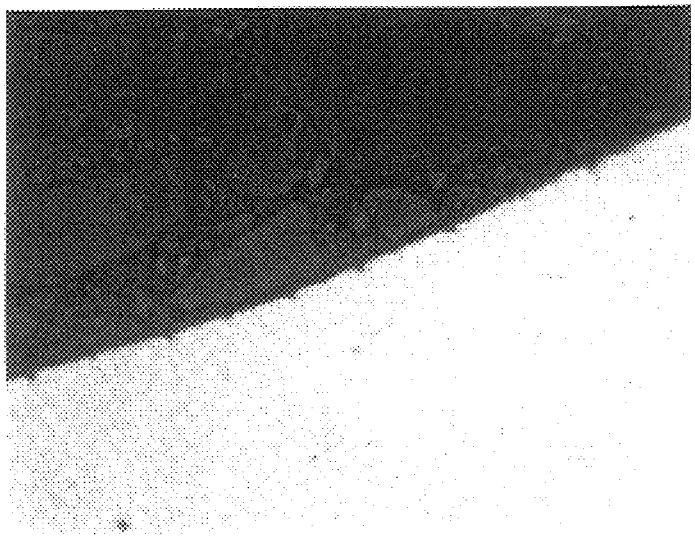

Figure 1 The 101st machined cylinder barrel revealed small specks mostly up to 0.00006 inch in depth in the cooling fin roots after black oxide treatment using 80%NaOH / 10%$NaNO_3$ / 10%$NaNO_2$. 1013X

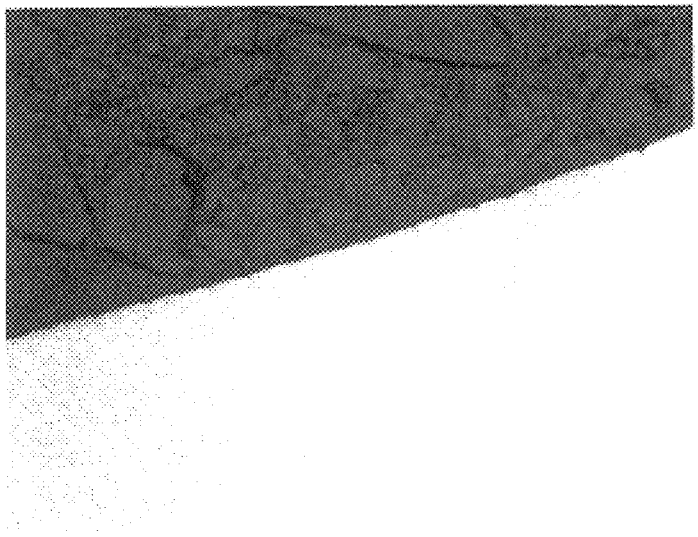

Figure 2 The 101st machined cylinder barrel revealed no specks in general, but a few localized areas exhibited small specks up to 0.00003 inch in depth in the cooling fin roots after black oxide treatment using 60%NaOH / 20%$NaNO_3$ 20%$NaNO_2$. 1013X

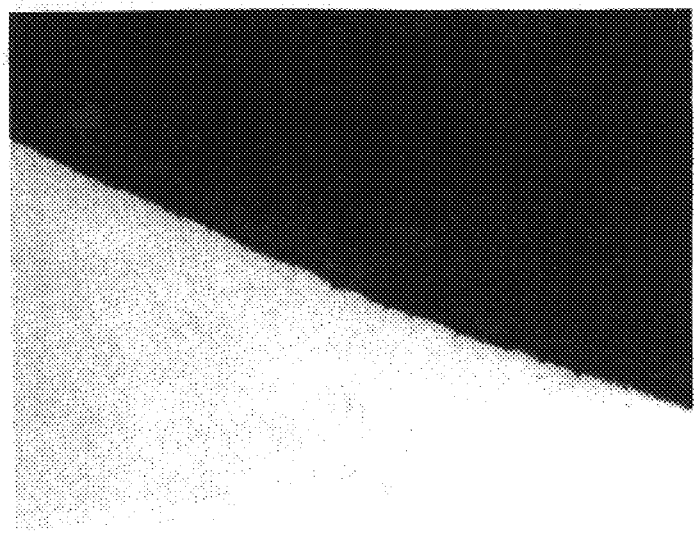

Figure 3 The 101st machined cylinder barrel revealed no specks in general, but a few localized areas exhibited very small specks up to 0.00003 inch in depth in the cooling fin roots after black oxide treatment using 80%NaOH/ 20%$NaNO_2$. 1013X

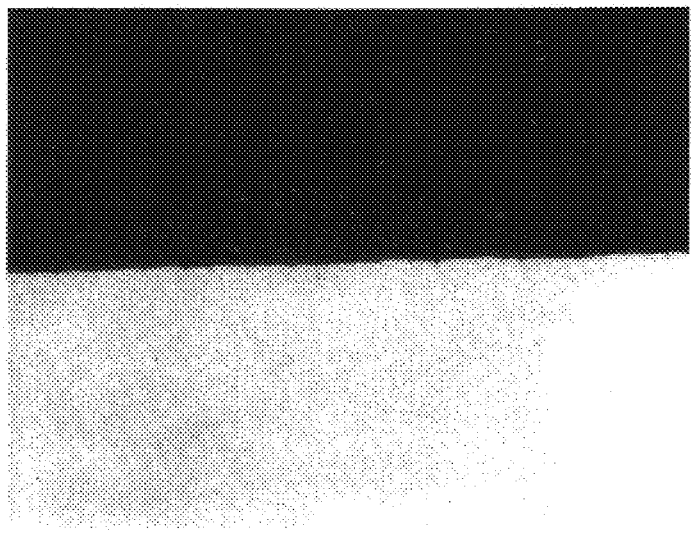

Figure 4 The 101st machined cylinder barrel revealed no specks in general, with fewer localized areas exhibiting very small specks up to 0.00003 inch in depth in the cooling fin roots after black oxide treatment using 60%NaOH/ 30%$NaNO_2$ / 10% $NaNO_3$. 1013X

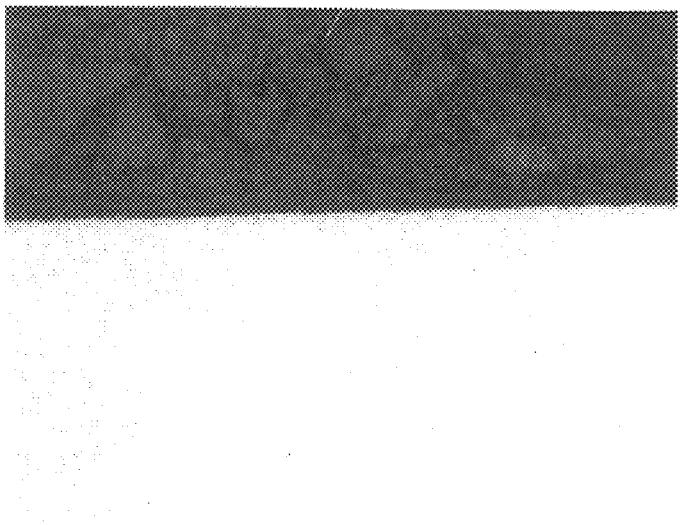
Figure 5 The 101st machined cylinder barrel revealed yet even fewer specks in the cooling fin roots after black oxide treatment using 60%NaOH / 40% $NaNO_2$. 1013X
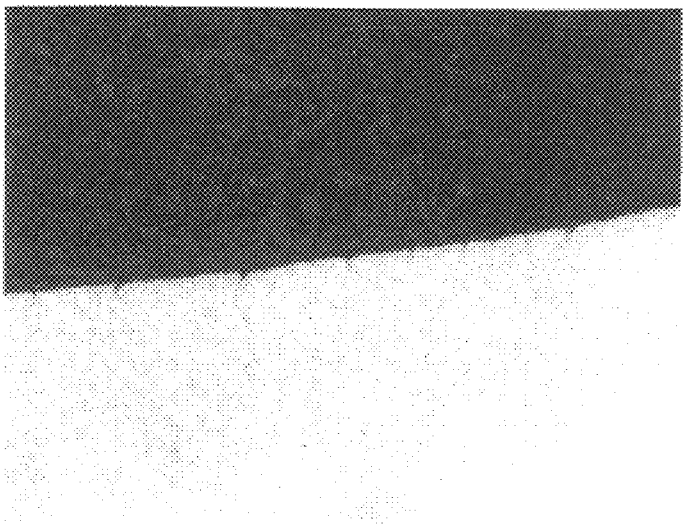
Figure 6 The 101st machined cylinder barrel revealed many hairline cracks up to 0.00038 inch in depth in the cooling fin roots after black oxide treatment using 60%NaOH / 40%$NaNO_3$. 1013X

METHOD TO PREVENT SPECKS OR HAIRLINE CRACKS IN, AND PREMATURE FAILURE OF, AIRPLANE CYLINDER BARRELS

FIELD OF THE INVENTION

The present invention relates to an improved method for the manufacture of aircraft engine cylinder barrels to prevent their premature failure due to hairline cracks or specks thought to be caused by caustic stress corrosion cracking during black oxide treatment.

BACKGROUND OF THE INVENTION

Stress corrosion cracking, a serious problem in many industries because it may result in a brittle fracture of a normally ductile metal, is a progressive type of fracture, somewhat similar to fatigue. It is due to the combined action of corrosion and tensile stresses. These stresses may be either applied (external) or residual (internal). Cracks, which may be either transgranular or intergranular, depending on the metal and the corroding agent, grow gradually over a period of time until a critical size is reached at which point the stress concentration may cause a sudden brittle fracture of the remaining metal. As is normal in all brittle fractures, the cracks are perpendicular to the tensile stress. Usually there is little or no obvious visual evidence of corrosion.

Nearly all metals are susceptible to stress-corrosion cracking in the presence of tensile stresses in specific environments. For example, austenitic stainless steels, such as those of the 200 and 300 series, are subject to stress-corrosion cracking from chlorides and other halides when under tensile stress. Carbon and alloy steels are susceptible to stress corrosion cracking when exposed to caustic conditions; this phenomenon, often referred to as "caustic embrittlement," occurs, for example, following exposure to sodium hydroxide solutions; calcium, ammonium, and sodium nitrate solutions; mixed acids like sulfuric-nitric acid; hydrogen cyanide solutions; acidic hydrogen sulfide solutions; moist hydrogen sulfide gas; seawater; and molten sodium-lead alloys. Stainless steels are subject to caustic stress corrosion cracking (CSCC) following exposure to acid chloride solutions, such as magnesium chloride and barium chloride; sodium chloride-hydrogen peroxide solutions; hydrogen sulfide; sodium hydroxide-hydrogen sulfide solutions; and condensing steam from chloride waters. While most metals and alloys, including carbon steel, handle caustic corrosive environments well at room temperature, susceptibility to corrosion and to CSCC increases with increased alloy content, caustic concentration, temperature, and stress level.

Although specks or hairline cracks are known to be a cause of premature failure of engine cylinder barrels, the underlying cause of those specks or hairline cracks has been the subject of dispute among investigators. Investigators have detected specks or hairline cracks in the engine cylinder barrels of downed aircraft and other cylinder failures. For example, the National Transportation Safety Board ("NTSB")-Materials Laboratory found that a cylinder barrel with 188.1 hours of service taken from a Skyhawk 172 Cessna aircraft which made an emergency landing in Independence, OR on Jun. 14, 1998 was cracked in fatigue for almost the entire circumference initiating from the outside between the fourth and fifth cooling fin roots. They observed multiple fatigue cracking initiated from pre-existing hairline cracks less than 0.001 in. in depth. No other material abnormalities were found. Textron Lycoming also found specks or hairline cracks (<0.001 in. in depth) in the remaining cylinder barrels from the same aircraft engine. See Epperson, NTSB-Materials Laboratory Report No. 98-149 and -149A, September 1998; Kim, Textron Lycoming Materials Laboratory Report No. 11271, July 1998.

Subsequent follow-up investigation have revealed that specks or hairline cracks most likely were induced by CSCC during treatment of the cylinder barrel with a caustic black oxide solution during the manufacturing process. The black oxide bath currently typically used in the industry is composed of a solution containing 80% sodium hydroxide (NaOH), 10% sodium nitrate ($NaNO_3$), and 10% sodium nitrite ($NaNO_2$). Engine cylinder barrels coated with black oxide have an improved ability to retain oil on their surface, which in turn improves their scuff resistance or break-in, static color appearance, and minor corrosion resistance.

The observation that specks up to 0.00003 in. in depth were seen even in the first cylinder barrel machined, after a complete new set of tool bits was installed, and black oxided indicates the extent of the specks or hairline cracks observed may depend on the amount of residual stresses from machining that are present in the cylinder barrel. Specks or hairline cracks were seen on the cylinder barrel cooling fin roots where varying amounts of residual machining stresses were present. No specks or hairline cracks were observed prior to treatment with black oxide solution even though some surface irregularities begin to occur after the same tool bits are used to machine many cylinder barrels. Although the severity of observed specks or hairline cracks observed was sporadic in cylinder barrels numbered ninety through one hundred that had been machined with the same set of tool bits, more pronounced specks or hairline cracks were observed in machined and 80/10/10 black oxided cylinder barrels numbered 101 and thereafter.

The fact that the specks or hairline cracks were present only after black oxide treatment strongly suggests the cracking phenomenon is related to the caustic embrittlement of steel. It is possible that two basic reactions between hydrogen and steel are responsible for the mechanism of CSCC. First, during a corrosion reaction of steel from the aqueous phase, hydrogen adatoms ("$H_{ads}$") form on the steel's surface according to the reactions:

$$Fe = Fe^{++} + 2e^- \quad (1)$$

$$H^+ + e^- = H_{ads} \quad (2)$$

$H_{ads}$ produced via Equation (2) either may combine to form hydrogen molecules that evolve as gas bubbles or may become absorbed into the steel surface. Absorbed $H_{ads}$ diffuse into the steel to areas of high triaxial tensile stress, and embrittle the metal which eventually leads to the steel's premature failure. Although surface modifications may be designed to decrease the rate of absorbance and increase the rate of evolution, whether $H_{ads}$ are absorbed or evolved depends on the energetics of the steel's surface.

In the second possible reaction, molecular hydrogen is evolved on the steel surface during a corrosion reaction of steel from an aqueous phase. Pure molecular hydrogen gas then dissociates into atomic hydrogen (H) at clean deformed surfaces on the steel, according to the reactions:

$$2H^+ + 2e^- = H_2 \quad (3)$$

$$H_2 = H + H \quad (4)$$

The dissociated atomic hydrogen migrates to regions of high triaxial tensile stress in the steel matrix.

During treatment with black oxide, magnetite ($Fe_3O_4$) is formed on the cylinder barrel surface according to the following reactions. NaOH reacts with water and iron to produce sodium iron hydroxide and molecular hydrogen under the reaction:

$$4NaOH+2H_2O+Fe=Na_4Fe(OH)_6+H_2 \quad (5)$$

The molecular hydrogen produced can either evolve into the air as gas bubbles or be absorbed into the steel surface as described above. The sodium iron hydroxide is then oxidized to form NaOH, water, and magnetite film on the steel surface according to the reaction:

$$3Na_4Fe(OH)_6+1/2O_2=Fe_3O_4+12NaOH+H_2O \quad (6)$$

The amount of atomic hydrogen diffusing into the steel surface, and thereby the likelihood that CSCC will occur, may be reduced if a sufficient amount of a reactant is available to react with the molecular hydrogen generated in Equation (5). For example, should a sufficient amount of sodium nitrite be available on the steel surface, molecular hydrogen may be removed according to the reaction:

$$2NaNO_2+3H_2=2H_2O+N_2+2NaOH \quad (7)$$

Current conditions for black oxide treatment of cylinder barrels (80% NaOH, 10% $NaNO_3$, 10% $NaNO_2$) do not utilize reactants at concentrations sufficient to remove significant quantities of either molecular or atomic hydrogen from the black oxide bath, particularly since sodium nitrate may not remove hydrogen from the metal surface. It is therefore desirable to provide a process for oxide treatment of aircraft engine cylinder barrels which can remove a significant amount of molecular and/or atomic hydrogen during the black oxide treatment process and thereby reduce the occurrence of CSCC. Further, because it appears that residual stresses from the machining process determine the extent of the specks or hairline cracks that will develop for the given black oxide bath, it is desirable to establish criteria to determine the maximum amount of cylinder barrels that can safely be machined from a given set of tool bits before replacement of these tool bits becomes obligatory. The present invention addresses this problem.

OBJECTS OF THE INVENTION

Accordingly, it is a general object of the present invention to provide a method of manufacturing cylinder barrels to be used in aircraft engines which will prevent the barrels' premature cracking and failure due to caustic stress-corrosion cracking. More specifically, it is an object of the present invention to provide a method of manufacturing cylinder barrels to be used in aircraft engines wherein an improved black oxide treatment process substantially reduces the amount of specks and completely eliminates hairline cracks in the barrels, thereby preventing the barrels' premature cracking and failure. It is a further object of the present invention to provide a method of manufacturing cylinder barrels to be used in aircraft engines wherein the contribution of residual stresses produced by machining to the barrels' premature cracking and failure due to caustic stress-corrosion cracking is minimized.

SUMMARY OF THE INVENTION

An improved method of manufacturing aircraft engine cylinder barrels to minimize caustic stress corrosion cracking is provided wherein the improvement comprises the step of immersing a machined cylinder barrel in a black oxide chemical bath, wherein the bath comprises a solution comprised of about 60% sodium hydroxide, about 0% sodium nitrate, and about 40% sodium nitrite. In another embodiment, the process further includes machining no more than a selected number of cylinder barrels on a given set of tool bits, the number selected such that a surface of the barrels is essentially free of detectible specks or hairline cracks after black oxide treatment. The invention further includes aircraft engine cylinder barrels manufactured according to these improved processes wherein a surface of the machined engine cylinder barrel is essentially free of specks or hairline cracks after black oxide treatment.

BRIEF DESCRIPTION OF THE DRAWINGS

The present invention is further described in the detailed description which follows, by reference to the noted drawings by way of non-limiting exemplary embodiments, in which like reference numerals represent similar parts throughout the several views of the drawings, and wherein:

FIG. 1 depicts an image though a scanning electron microscope of a machined cylinder head after black oxide treatment using an 80% NaOH/10% NaNO3/10% NaNO2 solution;

FIG. 2 depicts an image though a scanning electron microscope of a machined cylinder head after black oxide treatment using a 60% NaOH/20% NaNO3 solution;

FIG. 3 depicts an image though a scanning electron microscope of a machined cylinder head after black oxide treatment using an 80% NaOH/20% NaNO2 solution;

FIG. 4 depicts an image though a scanning electron microscope of a machined cylinder head after black oxide treatment using an 60% NaOH/10% NaNO3/30% NaNO2 solution;

FIG. 5 depicts an image though a scanning electron microscope of a machined cylinder head after black oxide treatment using an 60% NaOH/40% NaNO2 solution;

FIG. 6 depicts an image though a scanning electron microscope of a machined cylinder head after black oxide treatment using an 60% NaOH/40% NaNO3 solution;

DETAILED DESCRIPTION OF THE INVENTION

Two variables are significant to development of specks or hairline cracks in machined engine cylinder barrels after black oxide treatment: the chemical composition of the black oxide bath mixture and residual stresses produced by machining.

The standard industry method used to place an oil-retentive black oxide coat on the surface of an aircraft engine cylinder barrel, among other industrial uses, employs a bath solution of sodium hydroxide (NaOH), sodium nitrate ($NaNO_3$), and sodium nitrite ($NaNO_2$) in a standard ratio of 80/10/10. The 80/10/10 solution is prepared by dissolving in a gallon of water 5.5 lb premixed, dry NaOH, $NaNO_3$, and $NaNO_2$ which are combined so that the ratio of NaOH/$NaNO_3$/$NaNO_2$ in the dry mix is 80/10/10 by weight and the resulting solution boils at 285–290 degrees Fahrenheit. We performed the following series of experiments to determine the effect, if any, on the observed amount and extent of specks or hairline cracks of varying the composition of the solution.

Metallurgical Testing. For metallurgical testing, high order machined cylinder barrel test pieces were treated in a black oxide chemical bath containing a solution composed of: 80% NaOH/10% $NaNO_3$/10% $NaNO_2$ (80/10/10); 60% NaOH/20% $NaNO_3$/20% $NaNO_2$ (60/20/20); 80% NaOH/20% $NaNO_2$ (80/0/20 or 80/20); 60% NaOH/10% $NaNO_3$/30% $NaNO_2$, (60/10/30); 60% NaOH/40% $NaNO_3$ (60/40/0); and 60% NaOH/40% $NaNO_2$ (60/0/40, or 60/40).

These solutions can readily be prepared as follows. The 60/20/20 solution, for example, is prepared by dissolving in a gallon of water 7.0 lb premixed, dry NaOH, $NaNO_3$, and $NaNO_2$ which are combined so that the ratio of NaOH/$NaNO_3$/$NaNO_2$ in the dry mix is 60/20/20 by weight and the resulting solution boils at 285–290 degrees Fahrenheit. The 60/40 solution is likewise prepared by dissolving in a gallon of water 7.5 lbs premixed, dry NaOH, $NaNO_3$, and $NaNO_2$ which are combined so that the ratio of NaOH/$NaNO_2$ or NaOH/$NaNO_3$ in the dry mix is 60/40 by weight and the resulting solution boils at 285–290 degrees Fahrenheit.

For each bath solution, the cooling fin roots from cylinder barrel number 101 were analyzed for the presence and location of specks and/or hairline cracks. The results of this study are shown in FIGS. 1–6. As shown in FIG. 1, test samples treated with the industry-standard 80/10/10 solution showed pronounced specks up to 0.00006 in. in depth. Generally, as shown in FIGS. 2 and 3, no specks were observed in test samples treated with the 60/20/20 and the 80/20 solutions, but a few localized areas did exhibit small specks up to 0.00003 in. deep. As shown in FIG. 4, test barrels treated with the 60/10/30 solution exhibited specks up to 0.00003 in. deep in a few less localized areas. As shown in FIG. 5, a black oxide bath solution containing 60% NaOH/40% $NaNO_2$ most effectively prevents specks and hairline cracks. Test samples treated with 60% NaOH and 40% $NaNO_2$ showed substantially no specks or hairline cracks in the cooling fin roots. As shown in FIG. 6, many hairline cracks up to 0.00038 in. in depth were observed in test samples treated with 60% NaOH and 40% $NaNO_3$.

Once we determined the chemical composition of black oxide that was most effective in reducing observed specks or hairline cracks caused by caustic stress corrosion cracking, we compared black oxide coating characteristics—oil retention, abrasive resistance, corrosion, break-in, and the color of cylinder barrels treated in the different black oxide solutions to those obtained in cylinder barrels treated with the standard 80/10/10 black oxide bath. X-ray diffraction tests were performed to confirm the coating formed during the black oxide treatments, and the result was used to reconfirm the mechanism described previously. Cylinder barrel panels were bathed in five different black oxide bath solutions, namely 80% NaOH/10% $NaNO_3$/10% $NaNO_2$ (80/10/10); 60% NaOH/20% $NaNO_3$/20% $NaNO_2$ (60/20/20); 80% NaOH/20% $NaNO_2$ (80/0/20 or 80/20); 60% NaOH/10% $NaNO_3$/30% $NaNO_2$ (60/10/30); and 60% NaOH/40% $NaNO_2$ (60/0/40).

For these tests, one hundred 1 in.×4 in.×0.065 in. test panels (unless otherwise specified) were prepared either from a rectangular 1 in.×4 in. SAE 4140 bar stock or a 4.5 in. diameter round bar stock. Panels were divided into five test groups with twenty panels per group. Test panels were nitrided and honed on both surfaces for the oil retention, corrosion, and abrasion analyses; only one surface was nitrided and honed for the color and x-ray diffraction analyses. Following black oxide treatment, all test panels were treated with rust-preventive MetalGuard 450 oil. For testing, the oil was then removed by soaking in mineral spirits for five to ten minutes followed by acetone rinse.

Abrasion Tests.

Taber abrasion tests were conducted by Ithaca Materials Research Testing Laboratory (IMR, Lansing, N.Y.). Black oxide-coated samples were tested on a Taber Abraser according to specification ASTM D-4060 with 500 g weights and CS-10 wheels. Twenty-five cycles was determined to be an appropriate test length for these thinly coated samples. Results are shown in Table 1. Although test results were inconsistent due to the thin coating of oil on the panels, we conclude that the black oxide coating achieved using a 60/40 solution had slightly inferior abrasion resistance compared to that using the standard 80/10/10 solution. The test group treated with the 80/10/10 solution exhibited the best average abrasion resistance (0.0058 g average for both sides). The 60/40 mixture group had an abrasion resistance (0.0100 g average for both sides) slightly worse than that of the 80/10/10 group. The test group treated with the 80/20 solution exhibited the worst abrasion resistance (0.0150 g average for both sides).

Corrosion Test.

Because black oxide coating provides only minor corrosion protection, Hubbard-Hall, Inc., Waterbury, Conn., conducted the corrosion tests in a humidity chamber per ASTM D-2247 rather than in a salt spray chamber per ASTM B-117. Black oxide-coated panels were soaked in Aquaease PL 72-A32, cleaned in methylene chloride to remove any residual oil, and then placed into the humidity chamber. The test results, expressed in terms of time before initial rust development, are summarized in Table 2. Although the overall test results did not reveal any measurable difference in the groups' resistance to rust, the 60/40 black oxide solution group exhibited the best rust resistance, averaging 174.8 hours before rust began to develop.

Oil Retention Tests.

No standard test methods or specifications were available to analyze oil retention. Thus, Ithaca Materials Research Testing Laboratory (IMR, Lansing, N.Y.) used the following method. Samples were soaked in iso-octane for two minutes, dried, and weighed. They then were immersed in Textron Lycoming engine oil for 30 seconds, allowed to drain for 30 seconds, placed between a lint-free cloth and a 4.5 lb rubber-faced roller, and the roller rolled over the samples five times. This process was repeated using a new cloth, and the samples were weighed. Any weight gain was assumed to correlate to retained oil. Results obtained are shown in Table 3. There was no noticeable difference in oil retention properties between the sample groups. Somewhat lower oil retention was measured with the 60/20/20, 60/10/30, and 80/20 solutions. However, the average weight gain measured was lower for the 60/40 solution (0.0366 g) than for the industry-standard 80/10/10 solution (0.0368 g).

Color Tests.

Color testing of the treated panels was conducted at Hunter Laboratory, Reston, Va., and funded by Hubbard-Hall, Inc., Waterbury, Conn., according to specification ASTM D-2244 using an Ultra Scan XE spectrophotometer which measures visual wavelength (380–750 nm) photometric response and then records the reflectance. Color is measured in terms of lightness (L) and tint (a and b). For example, when L=0, a=0, and b=0, the color is perfect black without any tint. L varies from 0, perfect black, to 100, perfect white. Any color in the spectrum can be expressed in terms of the L, a, and b parameters: "+a" means red tint, "−a" means green tint, "+b" means yellow tint and "−b" means blue tint.

The major compound formed on the surface coating of the panels following black oxide treatment is magnetite, $Fe_3O_4$, which appears black. Some $Fe_2O_3$ is present as well, which appears red-brown to black. The varying amount of $Fe_2O_3$ on panel surfaces appears to cause the slight color differences.

Test results are summarized in Tables 4a and 4b for the convex side, nitrided surface and the concave side, non-nitrided surface, respectively. There were some measurable differences in color between the nitrided and non-nitrided surface. Non-nitrided surfaces were more brownish and darker in color and tint. Panels treated with the 60/40 solution were more brownish with the same degree of black when compared to the industry-standard 80/10/10 solution.

X-Ray Diffraction Tests.

X-ray diffraction tests were conducted by Lambda Research, Cincinnati, Ohio. Coatings on the panels were removed by placing the panels in toluene for at least ten minutes and then rinsing them with acetone while they were still wet from the toluene. X-ray diffraction patterns were obtained using graphite monochromated copper K-alpha radiation on a computer-controlled, Bragg-Brentano focusing geometry horizontal diffractometer. Patterns were analyzed using first and second derivative algorithms, after Golay digital filter smoothing, to determine the angular position and the absolute and relative intensities of each detectable diffraction peak. The diffraction pattern obtained was then compared to tabulated patterns in the Powder Diffraction File published by the Joint Committee on Powder Diffraction Standards for identification of the phase present using MDI computer search/match software.

The results of this qualitative phase analysis and additional information about the phases identified on each surface are presented in Tables 5a and 5b for the convex side, nitrided surface and concave side, non-nitrided surface, respectively. The main phase formed during black oxide treatment in all solutions was $Fe_3O_4$ or $FeCr_2O_4$ spinel phase, on both the convex side, nitrided surface and concave side, non-nitrided surface of the panels. The $Fe_2O_3$ rhombohedral oxide phase also present on both surfaces most likely occurred as a by-product result of the black oxide treatment.

Test results therefore show nearly no specks and no hairline cracks in cylinder barrel cooling fin roots subjected to a black oxide bath solution composed of 60% NaOH and 40% $NaNO_2$. This solution preserved the oil retention, color, scuff resistance, and anti-corrosion properties of the industry-standard 80/10/10 solution.

Engine Performance Tests.

Engine tests were performed to determine the effects, if any, of the new black oxide coating on engine break-in characteristics. Actual cylinder barrels treated using the standard 80/10/10 and new 60/40 black oxide bath were tested in the actual engine. More specifically, two cylinder assemblies, P/N 16A22130-YA, in which the barrels had been black oxide treated in the 60/40 bath were included in test runs on IO-360-A1B6D engine, S/N L-959-X at cylinder locations No. 1 and 4. For comparison, two standard cylinder assemblies, P/N 16A22130, were included in engine locations No. 2 and 3.

The total accumulated test time was 164 hours. A special run-in test was performed for the first twelve hours to investigate the break-in characteristics of the black oxided cylinder barrels. Testing then was continued for an additional 152 hours to build the endurance test time. The cylinder barrel dimensions, average cylinder barrel surface roughness (intake side and exhaust side), piston pin plug dimensions, as well as piston ring gaps and tensions were measured after 6, 12, 79, and 164 hours of running time.

The resulting test data revealed no significant difference in the break-in characteristics of cylinders black oxide coated in 80/10/10 and 60/40 black oxide baths. No significant differences in cylinder barrel wear, piston plug wear, piston ring gaps, and cylinder barrel roughness were observed.

No specks or hairline cracks are visible in cylinder barrels until after black oxide treatment. It is known that residual stress in the surface of cylinder barrels from machining causes specks or hairline cracks to occur by caustic stress corrosion cracking when such barrels are subjected to the black oxide bath. The possibility of hydrogen diffusing into the metal has been reduced, if not eliminated, by increasing the $NaNO_2$ in the bath so that the development of specks or hairline cracks can be prevented. We also have found that the lower the residual stresses from machining, the lower the probability that specks or hairline cracks will occur during black oxide treatment. Thus, it appears that the extent of the specks or hairline cracks visualized on cylinder barrels also may depend, at least in part, on the amount of residual stresses induced by machining present in the cylinder barrel. The maximum number of cylinder barrels free of specks or hairline cracks after black oxide treatment therefore determines the maximum number of cylinder barrels to be machined on a given set of tool bits.

While the invention has been described in connection with exemplary embodiments thereof, it will be understood that many modifications in both design and use will be apparent to those of ordinary skill in the art, and this application is intended to cover any adaptations or variations thereof. Therefore, it is manifestly intended that the claims and the equivalents thereof only limit this invention.

TABLE 1

Taber abrasion test results with 500 gram weights and CS-10 wheels.

| Sample No | Black Oxide Bath | Side 1 Weight Loss, gram | Side 2 Weight Loss, gram |
|---|---|---|---|
| 1-1 | 80/10/10 | 0.0045 | — |
| 1-2 | 80/10/10 | 0.0050 | 0.0038 |
| 1-3 | 80/10/10 | 0.0098 | — |
| 1-4 | 80/10/10 | 0.0038 | — |
| 1-5 | 60/20/20 | 0.0024 | — |
| 1-6 | 60/20/20 | 0.0122 | — |
| 1-7 | 60/20/20 | 0.0176 | — |
| 1-8 | 60/20/20 | 0.0052 | 0.0074 |
| 1-9 | 60/40 | 0.0078 | 0.0102 |
| 1-10 | 60/40 | 0.0239 | 0.0038 |
| 1-11 | 60/40 | 0.0139 | 0.0079 |
| 1-12 | 60/40 | 0.0077 | 0.0039 |
| 1-13 | 60/30/10 | 0.0077 | 0.0212 |
| 1-14 | 60/30/10 | 0.0130 | 0.0334 |
| 1-15 | 60/30/10 | 0.0123 | 0.0087 |
| 1-16 | 60/30/10 | 0.0268 | — |
| 1-17 | 80/20 | 0.0097 | 0.0182 |
| 1-18 | 80/20 | 0.0050 | 0.0082 |
| 1-19 | 80/20 | 0.0088 | 0.0057 |
| 1-20 | 80/20 | 0.0015 | 0.0086 |

TABLE 2

Corrosion test results obtained from the humidity chamber per ASTM D-2247.

| Sample Number | Black Oxide Bath | Time, hour |
|---|---|---|
| 2-1 | 80/10/10 | 165 |
| 2-2 | 80/10/10 | 165 |
| 2-3 | 80/10/10 | 190 |
| 2-4 | 80/10/10 | 149 |
| 2-5 | 60/20/20 | 149 |
| 2-6 | 60/20/20 | 165 |
| 2-7 | 60/20/20 | 172 |
| 2-8 | 60/20/20 | 190 |
| 2-9 | 60/40 | 172 |
| 2-10 | 60/40 | 190 |
| 2-11 | 60/40 | 172 |
| 2-12 | 60/40 | 165 |
| 2-13 | 60/30/10 | 149 |
| 2-14 | 60/30/10 | 172 |
| 2-15 | 60/30/10 | 172 |
| 2-16 | 60/30/10 | 149 |
| 2-17 | 80/20 | 149 |
| 2-18 | 80/20 | 149 |
| 2-19 | 80/20 | 190 |
| 2-20 | 80/20 | 149 |

TABLE 3

Oil retention test results obtained from test panels which were black oxide treated in various baths.

| Sample No. | Black Oxide Bath | Weight Gain, gram |
|---|---|---|
| 3-1 | 80/10/10 | 0.0302 |
| 3-2 | 80/10/10 | 0.0390 |
| 3-3 | 80/10/10 | 0.0428 |
| 3-4 | 80/10/10 | 0.0351 |
| 3-5 | 60/20/20 | 0.0355 |
| 3-6 | 60/20/20 | 0.0276 |
| 3-7 | 60/20/20 | 0.0329 |
| 3-8 | 60/20/20 | 0.0329 |
| 3-9 | 60/40 | 0.0375 |
| 3-10 | 60/40 | 0.0384 |

TABLE 3-continued

Oil retention test results obtained from test panels which were black oxide treated in various baths.

| Sample No. | Black Oxide Bath | Weight Gain, gram |
|---|---|---|
| 3-11 | 60/40 | 0.0344 |
| 3-12 | 60/40 | 0.0360 |
| 3-13 | 60/30/10 | 0.0317 |
| 3-14 | 60/30/10 | 0.0289 |
| 3-15 | 60/30/10 | 0.0301 |
| 3-16 | 60/30/10 | 0.0252 |
| 3-17 | 80/20 | 0.0358 |
| 3-18 | 80/20 | 0.0308 |
| 3-19 | 80/20 | 0.0377 |
| 3-20 | 80/20 | 0.0331 |

TABLE 4a

Color test results on convex side, nitrided surface.

| Sample No. | Black Oxide Bath | L (average), lightness | a (average), tint | b (average), tint | Note |
|---|---|---|---|---|---|
| 4-1 to 4-4 | 80/10/10 | 36.14 | 0.02 | −0.08 | gray black-neutral |
| 4-5 to 4-8 | 60/20/20 | 35.53 | 0.10 | 0.54 | little brownish black |
| 4-9 to 4-12 | 60/40 | 37.20 | −0.18 | 1.06 | brownish black |
| 4-13 to 4-16 | 4-13 to 4-16 | 37.03 | −0.05 | 0.04 | gray black-neutral |
| 4-17 to 4-20 | 80/20 | 30.09 | 0.22 | 0.15 | little brownish black |

TABLE 4b

Color test results on concave side, non-nitrided surface.

| Sample No. | Black Oxide Bath | L (average), lightness | a (average), tint | a (average), tint | Note |
|---|---|---|---|---|---|
| 4-1 to 4-4 | 80/10/10 | 32.78 | 1.37 | 1.94 | more brownish black |
| 4-5 to 4-8 | 60/20/20 | 35.65 | 0.47 | 1.84 | brownish black |
| 4-9 to 4-12 | 60/40 | 31.07 | 0.78 | 1.69 | brownish black |
| 4-13 to 4-16 | 60/30/10 | 32.19 | 0.44 | 1.31 | brownish black |
| 4-17 to 4-20 | 80/20 | 31.17 | 1.40 | 3.70 | more brownish black |

TABLE 5a

X-ray diffraction test results on convex, nitrided surface.

| Sample No. | Black Oxide Bath | $Fe_{2-3}N$ Phase | $Fe_3O_4$ or $FeCr_2O_4$ Phase | $Fe_4N$ Phase | $Fe_2O_3$ Phase |
|---|---|---|---|---|---|
| 5-1 | 80/10/10 | Major | Major | Minor | Possible |
| 5-2 | 80/10/10 | Major | Major | Minor | — |

TABLE 5a-continued

X-ray diffraction test results on convex, nitrided surface.

| Sample No. | Black Oxide Bath | $Fe_{2-3}$ N Phase | $Fe_3O_4$ or $FeCr_2O_4$ Phase | $Fe_4N$ Phase | $Fe_2O_3$ Phase |
|---|---|---|---|---|---|
| 5-3 | 80/10/10 | Major | Minor | Minor | Possible |
| 5-4 | 80/10/10 | Major | Major | Minor | — |
| 5-5 | 60/20/20 | Major | Major | Minor | Possible |
| 5-6 | 60/20/20 | Major | Major | Minor | possible |
| 5-7 | 60/20/20 | Major | Major | Minor | — |
| 5-8 | 60/20/20 | Major | Major | Minor | — |
| 5-9 | 60/40 | Major | Major | Minor | — |
| 5-10 | 60/40 | Major | Major | Major | — |
| 5-11 | 60/40 | Major | Major | Minor | — |
| 5-12 | 60/40 | Major | Major | Minor | — |
| 5-13 | 60/30/10 | Major | Major | Minor | — |
| 5-14 | 60/30/10 | Major | Major | Major | — |
| 5-15 | 60/30/10 | Major | Major | Minor | — |
| 5-16 | 60/30/10 | Major | Major | Major | — |
| 5-17 | 80/20 | Major | Major | Minor | — |
| 5-18 | 80/20 | Major | Major | Minor | — |
| 5-19 | 80/20 | Major | Major | Minor | — |
| 5-20 | 80/20 | Major | Major | Minor | Possible |

TABLE 5b

X-ray diffraction test results on concave, non-nitrided surface.

| Sample No. | Black Oxide Bath | $Fe_4C$, Primitive Cubic Phase | Fe Phase, BCC* or BCT* | $Fe_3O_4$ or Fe $Cr_2O_4$ Phase | $Fe_2O_3$ Phase |
|---|---|---|---|---|---|
| 5-1 | 80/10/10 | Major | Major | Minor | — |
| 5-2 | 80/10/10 | Minor | Major | Minor | Possible |
| 5-3 | 80/10/10 | Major | Minor | Minor | — |
| 5-4 | 80/10/10 | Major | Major | Major | Possible |
| 5-5 | 60/20/20 | Major | Minor | Minor | — |
| 5-6 | 60/20/20 | Major | Minor | Minor | Possible |
| 5-7 | 60/20/20 | Major | Minor | Minor | Possible |
| 5-8 | 60/20/20 | Major | Minor | Minor | — |
| 5-9 | 60/40 | Major | Major | Minor | Minor |
| 5-10 | 60/40 | Major | Minor | Minor | Possible |
| 5-11 | 60/40 | Major | Minor | Minor | Minor |
| 5-12 | 60/40 | Major | Major | Minor | Possible |
| 5-13 | 60/30/10 | Major | Major | Minor | Minor |
| 5-14 | 60/30/10 | Major | Minor | Minor | Possible |
| 5-15 | 60/30/10 | Major | Minor | Minor | Possible |
| 5-16 | 60/30/10 | Major | Minor | Minor | Possible |
| 5-17 | 80/20 | Minor | Major | Possible | — |
| 5-18 | 80/20 | Tracer | Major | Possible | — |
| 5-19 | 80/20 | Minor | Major | Possible | — |
| 5-20 | 80/20 | Tracer | Major | Possible | — |

*BCC means body centered cubic and BCT means body centered tetragonal

What is claimed is:

1. An improved method of manufacturing aircraft engine cylinder barrels wherein the improvement comprises the step of:

immersing a machined cylinder barrel in a black oxide chemical bath, wherein the bath is comprised of water and about 60–80% sodium hydroxide by weight, about 0–20% sodium nitrate by weight, and about 20–40% sodium nitrite by weight.

2. The method of claim 1, wherein the bath is comprised of about 60% sodium hydroxide by weight, about 0% sodium nitrate by weight, and about 40% sodium nitrite by weight.

3. The method of claim 1, wherein the bath is comprised of about 60% sodium hydroxide by weight, 20% sodium nitrate by weight, and 20% sodium nitrite by weight.

4. The method of claim 1, wherein the bath is comprised of about 80% sodium hydroxide, and 20% sodium nitrite.

5. The method of claim 1, wherein the bath is comprised of about 60% sodium hydroxide by weight, about 10% sodium nitrate by weight, and about 30% sodium nitrite by weight.

6. The process of claim 1, further comprising the steps of:

tracking the number of said cylinder barrels machined on a given set of tool bits and bathed in said bath; and replacing said set of tools bits and said bath when the number of said cylinder barrels machined with said set of tool bits and bathed in said bath meets a predefined number selected such that a surface of the barrels is essentially free of detectible specks or hairline cracks after black oxide treatment.

7. A cylinder barrel manufactured according to the method of claim 1 wherein a surface of the machined cylinder barrel is essentially free of specks or hairline cracks.

8. A cylinder barrel manufactured according to the method of claim 2 wherein a surface of the machined cylinder barrel is essentially free of specks or hairline cracks.

9. A cylinder barrel manufactured according to the method of claim 3 wherein a surface of the machined cylinder barrel is essentially free of specks or hairline cracks.

10. A cylinder barrel manufactured according to the method of claim 4 wherein a surface of the machined cylinder barrel is essentially free of specks or hairline cracks.

11. A cylinder barrel manufactured according to the method of claim 5 wherein a surface of the machined cylinder barrel is essentially free of specks or hairline cracks.

* * * * *